US010721549B2

(12) United States Patent
Belonozhko et al.

(10) Patent No.: US 10,721,549 B2
(45) Date of Patent: Jul. 21, 2020

(54) DIRECT-RADIATING EARPHONE DRIVERS

(71) Applicant: 1964 EARS, LLC, Vancouver, WA (US)

(72) Inventors: Vitaliy Y. Belonozhko, Vancouver, WA (US); Vitaliy Gordeyev, Happy Valley, OR (US); Christopher E. Ogut, Portland, OR (US)

(73) Assignee: 1964 Ears, LLC, Vancouver, WA (US)

( * ) Notice: Subject to any disclaimer, the term of this patent is extended or adjusted under 35 U.S.C. 154(b) by 0 days.

(21) Appl. No.: 16/091,275

(22) PCT Filed: Jul. 22, 2017

(86) PCT No.: PCT/US2017/043419

§ 371 (c)(1),
(2) Date: Oct. 4, 2018

(87) PCT Pub. No.: WO2018/022469

PCT Pub. Date: Feb. 1, 2018

(65) Prior Publication Data

US 2019/0158944 A1 May 23, 2019

Related U.S. Application Data

(63) Continuation of application No. 15/657,120, filed on Jul. 22, 2017.

(Continued)

(51) Int. Cl.

| | |
|---|---|
| ***H04R 1/10*** | (2006.01) |
| ***H04R 3/00*** | (2006.01) |
| ***H04R 3/14*** | (2006.01) |
| ***H04R 11/02*** | (2006.01) |
| ***H04R 23/02*** | (2006.01) |
| ***H04R 1/24*** | (2006.01) |
| ***H04R 1/28*** | (2006.01) |
| ***H04R 1/26*** | (2006.01) |

(52) U.S. Cl.

CPC ..... *H04R 1/1016* (2013.01); *H04R 1/1075* (2013.01); *H04R 1/24* (2013.01); *H04R 1/26* (2013.01); *H04R 1/28* (2013.01); *H04R 1/2869* (2013.01); *H04R 3/14* (2013.01);

(Continued)

(58) Field of Classification Search

CPC ..... H04R 1/02; H04R 1/10; H04R 1/1016; H04R 1/1066; H04R 1/1075; H04R 1/2869; H04R 1/24; H04R 1/26; H04R 1/28; H04R 3/00; H04R 3/12; H04R 3/14;

(Continued)

(56) References Cited

U.S. PATENT DOCUMENTS 5,222,050 A * 6/1993 Marren ..... H04R 1/44 181/132

5,982,908 A 9/1999 Bauman (Continued)

*Primary Examiner* — Thang V Tran

(74) *Attorney, Agent, or Firm* — Mersenne Law

(57) ABSTRACT

A personal listening device including at least one direct-radiating balanced-armature audio transducer and at least one substantially enclosed, indirect-radiating, or tube-coupled balanced-armature transducer. The tube-connected transducer emits sound waves which pass through a hole, slot, tube or bore before entering an airspace near the eardrum of a user, while the direct-radiating transducer emits sound waves directly into the airspace adjacent the indirect-radiating transducer or tube, which airspace is contiguous with the airspace near the eardrum of the user.

9 Claims, 9 Drawing Sheets

Related U.S. Application Data

(60) Provisional application No. 62/365,981, filed on Jul. 23, 2016.

(52) U.S. Cl.
CPC ..... *H04R 11/02* (2013.01); *H04R 23/02* (2013.01); *H04R 2460/11* (2013.01)

(58) Field of Classification Search
CPC .... H04R 11/02; H04R 23/02; H04R 2460/11; H04R 25/02; H04R 25/60
See application file for complete search history.

(56) References Cited

U.S. PATENT DOCUMENTS 7,194,102 B2 * 3/2007 Harvey ..... H04R 1/1016 381/324
7,194,103 B2 * 3/2007 Harvey ..... H04R 1/1016 381/380
7,317,806 B2 * 1/2008 Harvey ..... H04R 1/1016 381/322
2008/0013774 A1 1/2008 Hosaka
2009/0103764 A1 * 4/2009 Stiehl ..... B29C 45/0025 381/380
2011/0038503 A1 * 2/2011 Yang ..... H04R 1/22 381/380
2011/0058702 A1 * 3/2011 Saggio, Jr. ..... H04R 1/1016 381/380
2013/0343564 A1 12/2013 Darlington
2013/0343593 A1 12/2013 Howes
2014/0140565 A1 * 5/2014 Liu ..... H04R 1/1091 381/380
2014/0205131 A1 7/2014 Asmi
2014/0226843 A1 * 8/2014 Pan ..... H04R 1/1075 381/309
2015/0304763 A1 10/2015 Wen

* cited by examiner

DIRECT-RADIATING EARPHONE DRIVERS

CONTINUITY AND CLAIM OF PRIORITY

This is a United States national-phase patent application filed under 35 U.S.C. § 371, which claims priority to U.S. provisional patent application No. 62/365,981 filed 23 Jul. 2016, U.S. utility patent application Ser. No. 15/657,120 filed 22 Jul. 2017, and PCT application no. PCT/US17/43419 filed 22 Jul. 2017.

FIELD

The invention relates to electro-acoustic audio transducers in the nature of headphones and earphones. More specifically, the invention relates to configurations of in-ear monitor components featuring improved acoustic rendition characteristics.

BACKGROUND

Traditional personal listening devices utilize one or more drivers as audio reproduction sources. The sound waves from these drivers are commonly carried from an enclosed, sub-miniature electro-acoustic transducer or driver, through a tube or sound bore connected thereto, to an opening near or within the user's ear canal. In such earphones, the device's overall frequency response is affected by the length and inner diameter of the tubing or bores used to direct the output of the drivers to the earpiece or tip of the device. This use of tubing or bores introduces tube resonance, affecting the frequency response of the driver connected to the tubing or bore. Tubing or bores also constrict the sound waves passed from the driver through the tube or bore, often complicating the acoustic design of the device or exerting a deleterious effect on the overall fidelity of the system.

Alternate arrangements of transducers and other components in earphones can simplify the design or construction of the device, or improve its sound-reproduction fidelity. These benefits may be of significant value in this field.

SUMMARY

Embodiments of the invention are multi-transducer in-ear monitors, earphones or canalphones, where at least one audio transducer is an indirect-radiating balanced armature that delivers its sound waves through a hole, slot, tube or bore, and at least one other audio transducer is a direct-radiating balanced armature that radiates its sound waves directly into a closed and substantially sealed airspace adjacent the first balanced armature's hole, slot, tube or bore. A main chamber of the earphone shell contains at least one front-vented driver placed with no direct coupling to other such drivers or to the ear canal. A ported chamber containing a front-vented driver may be connected to the main chamber; such ported chambers may be used to tune the response of particular drivers and frequency ranges. Sound combines in the main chamber before passing into the ear canal through a hollow sound stem. One or more front-vented high-frequency drivers may also be placed in the hollow sound stem for high-frequency emphasis. An embodiment may also contain one or more dynamic (moving coil) drivers.

DETAILED DESCRIPTION

Figure 1:
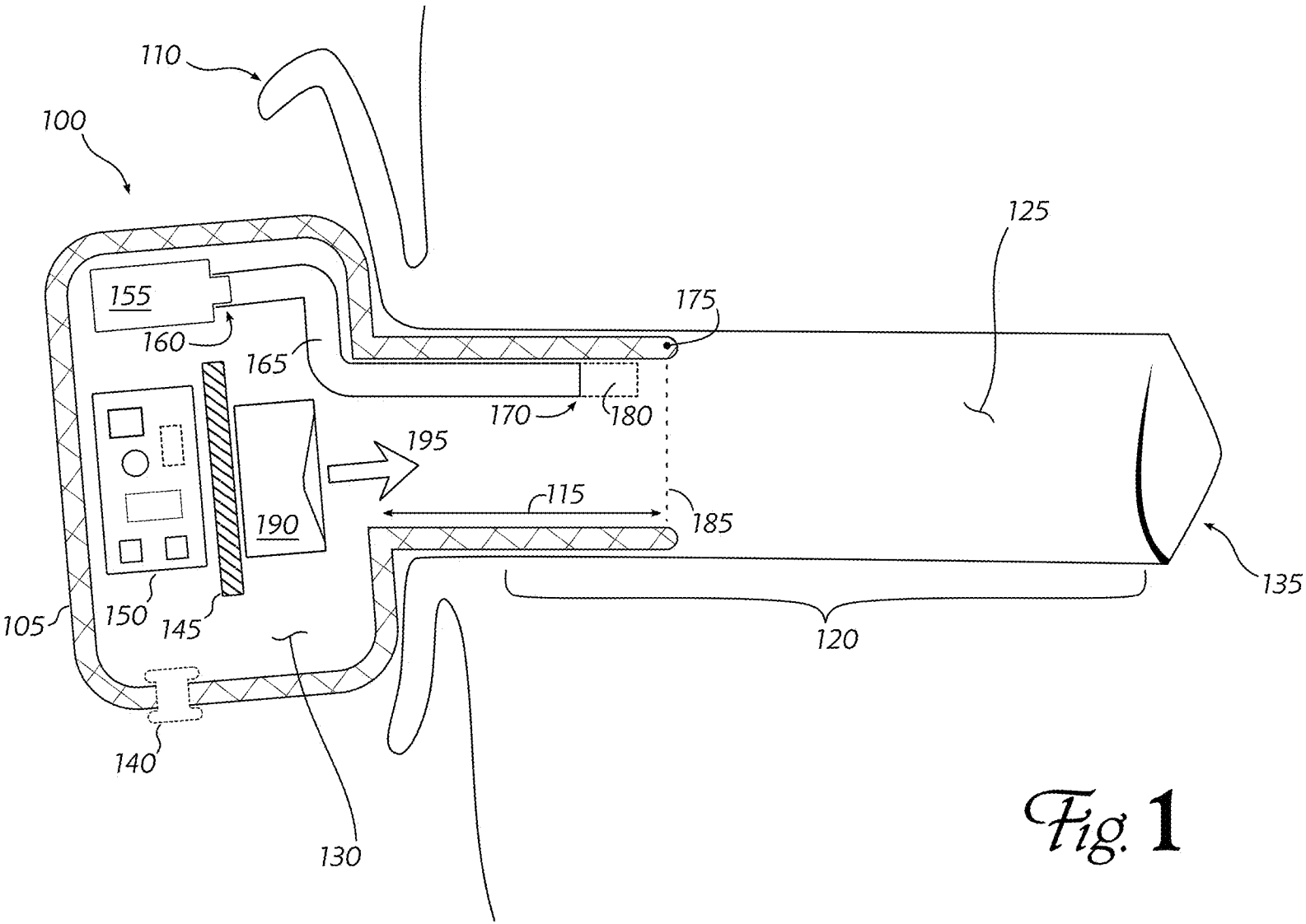
FIG. 1 is a simplified cutaway depiction of an earphone according to an embodiment of the invention, shown in place in a user's ear.

FIG. 1 is a simplified cutaway drawing of an embodiment of the invention, shown in place in a user's ear. An embodiment comprises a housing 100 (shell shown in crosshatching), generally with an enlarged portion 105 that rests in the user's outer ear (auricle cross-section at 110), and with a protrusion or stem 115 extending into the user's outer ear canal 120. The protrusion 115 is substantially sealed to the outer ear canal (it is typically either custom-molded to fit or provided with a compressible foam covering around the protrusion) to form a closed volume including the inner portion of the ear canal 125 and the airspace inside housing 100 (e.g. at 130). The volume is closed on the other end by the user's tympanic membrane (eardrum), 135. The volume may be vented by an acoustically opaque vent 140 which allows air to enter or escape slowly, improving insertion and removal comfort while not appreciably affecting the sound reproduction capabilities of the system.

The housing 100 may include interior partitions 145 to improve structural integrity and provide secure mounting points for components such as an electronic crossover network 150, which separates an electrical audio signal into sub-parts suitable for driving multiple audio transducers ("drivers," "speakers") contained within the housing. In prior-art earphones, and in embodiments of the invention, a driver 155 may be of the balanced-armature type, where the electromechanical mechanism is mostly or fully enclosed within a modular shell, said shell having a small "snout" or "spout" through which sound is emitted. (Instead of a spout, some balanced armatures emit sound through a hole or slot in the casing. A spout, as shown here, facilitates the attachment of a tube to carry sound waves from the transducer to another location within the housing.)

In the illustrated embodiment, sound from transducer 155 enters a tube 165 (or, in some embodiments, a bored channel or "bore" formed through portions of the housing). Tube 165 may terminate short of the end of the protrusion (170, end of protrusion at 175); or may extend near the end of the protrusion (dashed extension 180). The end of the protrusion may be covered by an acoustically-transparent mesh or screen 185 to protect the components inside housing 100 from damage or debris.

In an embodiment, at least one balanced armature 190 is disposed within housing 100, and emits its sound waves directly into the airspace 130 (as indicated by arrow 195)— these sound waves do not escape from the balanced armature's shell through a hole, slot or spout, and are not carried through a tube or bore. The sound-emitting diaphragm of this balanced armature is exposed and visible. This direct-radiating transducer may be within an enlarged portion of the housing and directed toward the ear canal and eardrum, as shown here, or one or more direct-radiating transducers may be placed within the protrusion and directed transversely across the ear canal. Some embodiments may include multiple tube-connected acoustic drivers and multiple direct-radiating acoustic drivers. Embodiments may also include acoustic transducers of other types, such as a moving-coil or "dynamic" driver, or an electrostatic driver.

Typically, the multiple audio transducers of an embodiment reproduce different audio frequency ranges, such as high frequencies, mid-range frequencies, and low frequencies. An input audio signal is separated into a suitable number of frequency ranges by the electronic crossover network, and the sub-portions of the signal are coupled to the appropriate audio transducer. An embodiment may use direct-radiating drivers for one frequency range and indirect-radiating drivers for another range. Alternatively, a frequency range may be supplied to both direct-radiating and indirect-radiating drivers. It is understood that the frequency ranges are not entirely distinct—for example, some sound energy at the upper or lower end of the middle frequency range may be produced by a transducer that is principally relied upon for high- or low-range reproduction.

Figure 3:
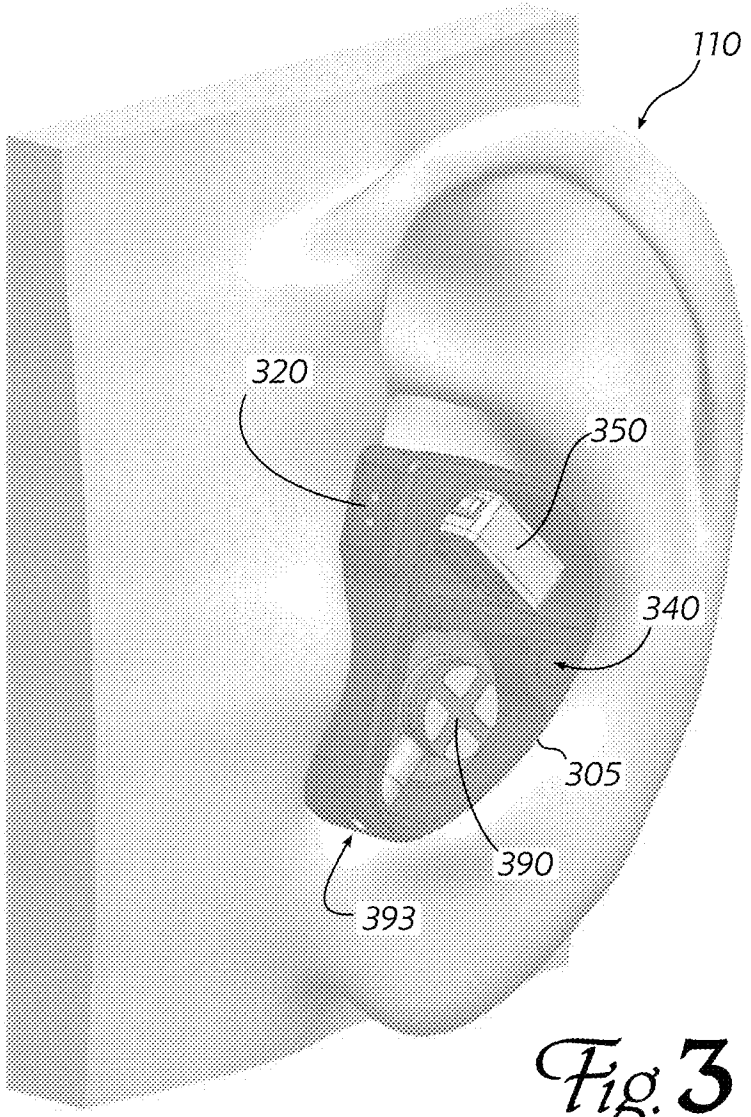
FIG. 3 shows a view of an earphone from the outside, with a protective cover removed.
Figure 2:
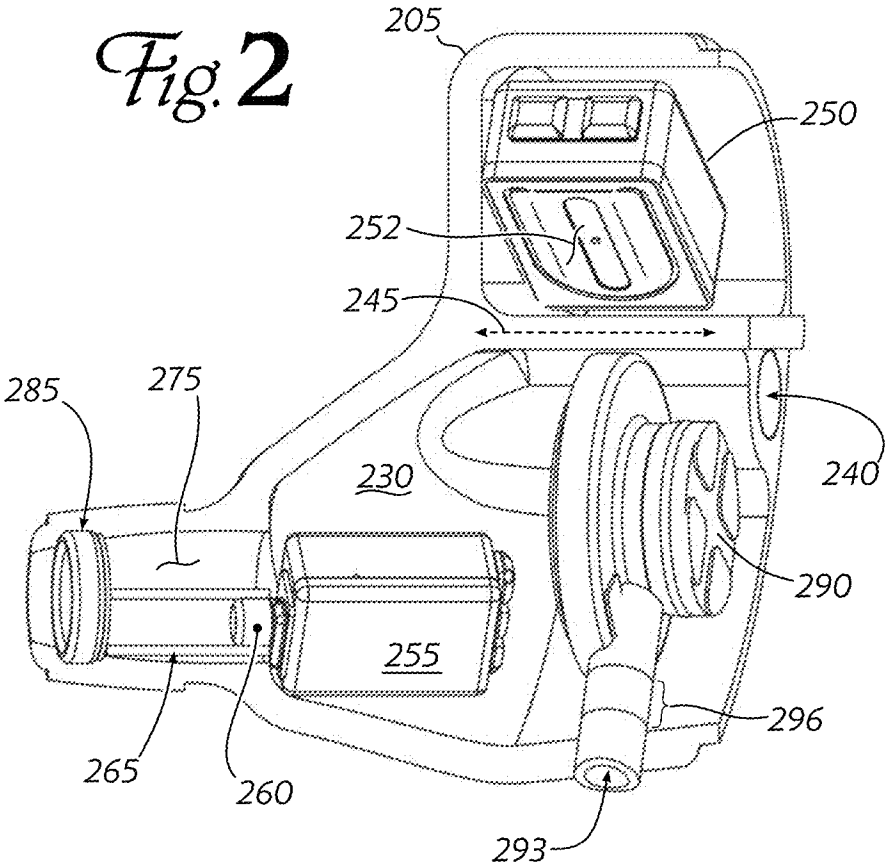
FIG. 2 shows a cutaway view of a more realistic earphone according to an embodiment of the invention.

FIG. 2 shows a partial cutaway, perspective view of an embodiment of the invention. FIG. 3 is a shaded view of substantially the same embodiment from a slightly different angle, shown inserted in a user's ear. In FIG. 2, the outer shell 205 holds several audio transducers: direct-radiating balanced armature 250, dynamic (moving coil) bass driver 290, and tube-coupled balanced armature 255. The direct-radiating balanced armature 250 emits sound waves from its exposed-and-visible diaphragm 252 directly into the interior airspace 230 (which is contiguous with the airspace adjacent the user's eardrum, refer to FIG. 1, 125). (It is appreciated that dynamic bass driver 290 also radiates sound from an exposed-and-visible diaphragm surface [although that surface is not visible from this vantage point]. But bass driver 290 is of a different type; it is not a balanced armature.)

In contrast to the direct-radiating balanced armature 250, tube-coupled balanced armature 255 emits sound through a snout at 260, and the sound travels through tube 265 before entering the interior airspace 230. As mentioned with reference to FIG. 1, tube 265 may extend most or all of the way down the stem, as shown here, or it may terminate short of the end of the stem. Thus, the sound waves in tube 265 travel adjacent to, but separated from, the sound waves radiated directly into airspace 230 by direct-radiating balanced armature 250. The portion of airspace 230 in the stem that is adjacent to tube 265 is identified by reference character 275. At the far end of the stem, nearest the user's eardrum, a ring or collet 285 carrying an acoustically-transparent screen snaps into place to protect the drivers and electronics inside the earphone housing from debris and moisture.

FIG. 2 also shows an interior partition 245 (dashed line), and the outside orifice 240 of an acoustically opaque vent that helps equalize pressure between the interior airspace 230 and the ambient atmosphere outside the user's ear. The back of bass driver 290 (i.e., the side opposite the radiating diaphragm) is also vented to the atmosphere through an orifice 293. The vent tube may be provided with a tuned filter (e.g. at 296), to control the low frequency response of the device.

In FIG. 3, some corresponding elements are visible: the outer shell 305, the outer orifice of the acoustically opaque vent 340, a direct-radiating balanced armature 350 and the back side of bass driver 390 (and also its vent orifice 393). Also visible in this Figure is an electrical connection 320 through which electrical power and/or audio signal can be coupled to the earphone. (Note that both FIGS. 2 and 3 are shown without the back cover that mostly closes the shell and creates the enclosed airspace within the earphone and adjacent airspace within the user's ear canal.

Figure 4:
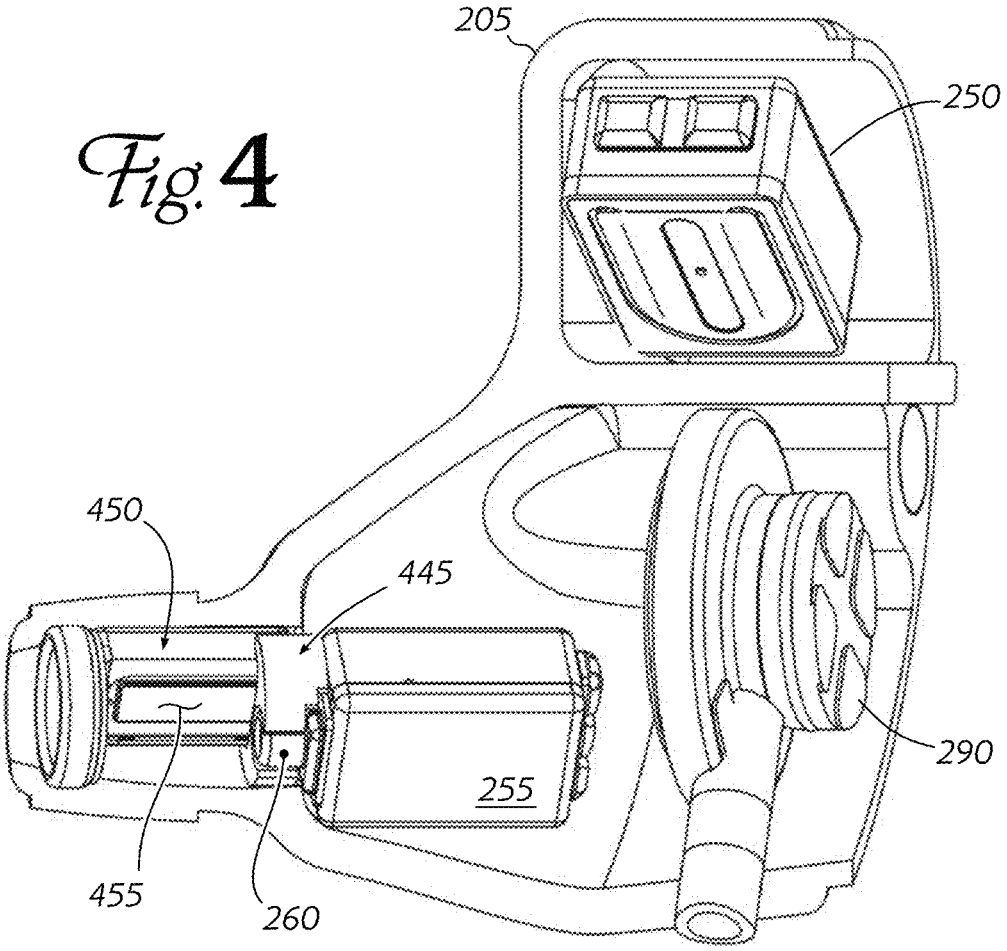
FIG. 4 shows a sectional view of another embodiment.

FIG. 4 shows another embodiment, similar to that of FIG. 2 (e.g., housing 205; direct-radiating balanced armature 250; dynamic driver 290), where another direct-radiating balanced armature 450 is placed in the open airspace of the stem so that the sound waves it radiates from its exposed diaphragm 455, across the stem airspace, combine with the sound waves from other audio transducers 250 and 290. In this embodiment, indirect-radiating balanced armature 255 emits sound waves through a short tube 260, so they enter the open airspace sooner than in FIG. 2. This Figure also shows that a mounting fitting or fixture 445 may be used to hold direct-radiating and tube-coupled transducers in a predetermined spatial relationship.

Figure 5:
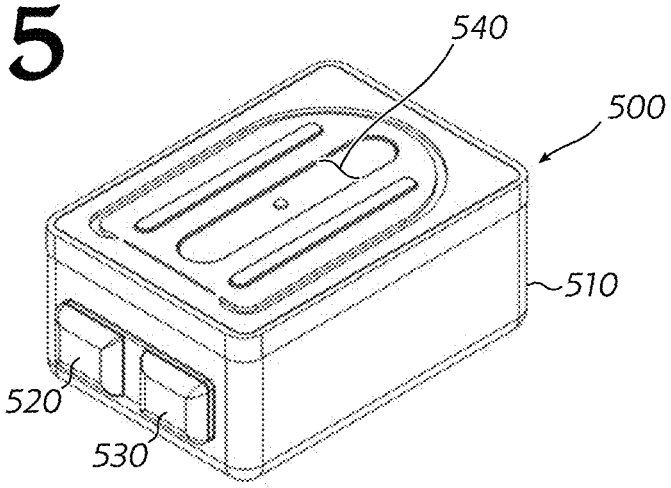
FIG. 5 shows a direct-radiating driver component as used in an embodiment of the invention.

FIG. 5 shows a typical modular balanced armature 500, which comprises a case 510, electrical contacts 520 & 530, and a radiating surface (diaphragm) 540 from which sound waves are emitted. Some modular balanced armatures further comprise a cover over the radiating surface 540, which contains the sound waves within the module and directs them to a predetermined exit orifice, such as a hole, slot, spout or snout. This latter type is generally referred to as a "closed" or "indirect-radiating" balanced-armature driver.

Figure 6A:
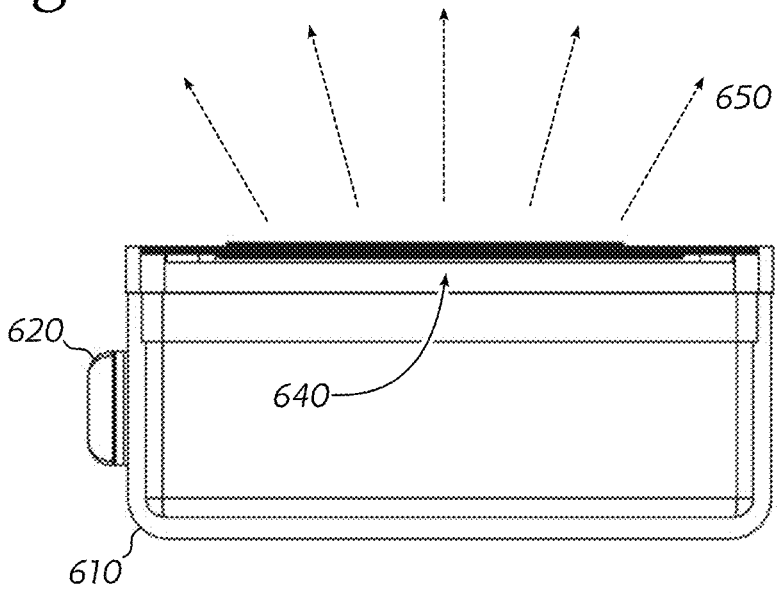
FIGS. 6A and 6B compare direct-radiating and tube-coupled driver components as used in an embodiment of the invention.
Figure 6B:
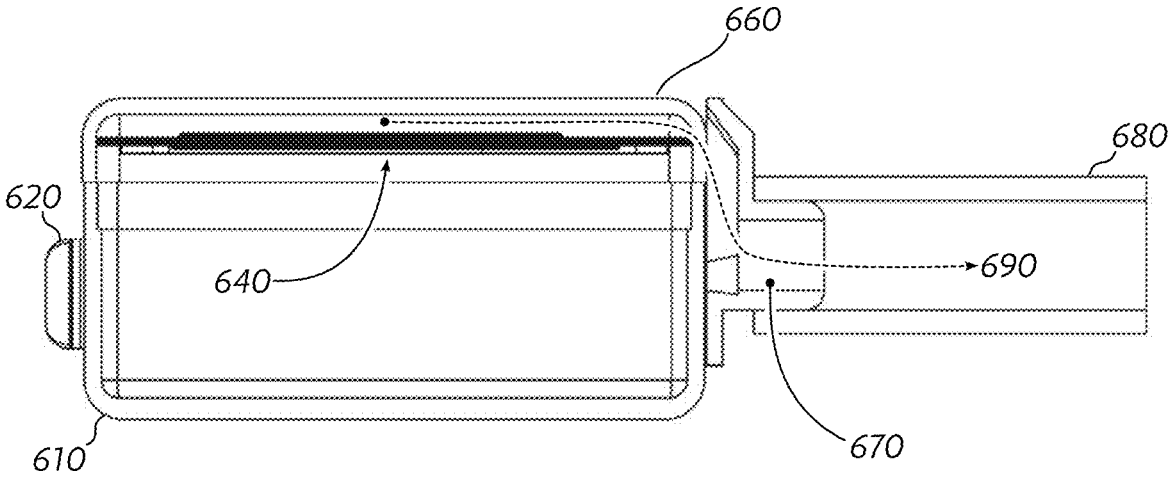

FIGS. 6A and 6B compare open and closed balanced-armature audio transducer modules. In FIG. 6A, like FIG. 5, the radiating surface 640 is exposed and visible, and sound waves are radiated roughly perpendicularly to the surface (650). In FIG. 6B, radiating surface 640 is covered by a cover or shell 660, which confines the sound waves radiated from 640 and forces them to travel through an opening in the shell at spout 670 (and through optional tube extension 680), as shown by dashed line 690. In the module of FIG. 6B, cover 660 conceals radiating surface or diaphragm 640 completely, so that it is not visible through spout 670. However, an embodiment may comprise a balanced-armature audio transducer module where cover 660 includes a hole, slot or perforations. In such a module, the sound-radiating diaphragm 640 may be partially visible, but the sound waves must still pass through the hole, slot or perforation to exit the module. In contrast, in an open and direct-radiating balanced-armature audio transducer, all (or substantially all) of the diaphragm is visible (FIGS. 5 & 6A). An embodiment of the invention is a headphone or earphone comprising both types of balanced-armature transducers (direct-radiating and slot-, hole-, tube- or bore-coupled).

Figure 7:
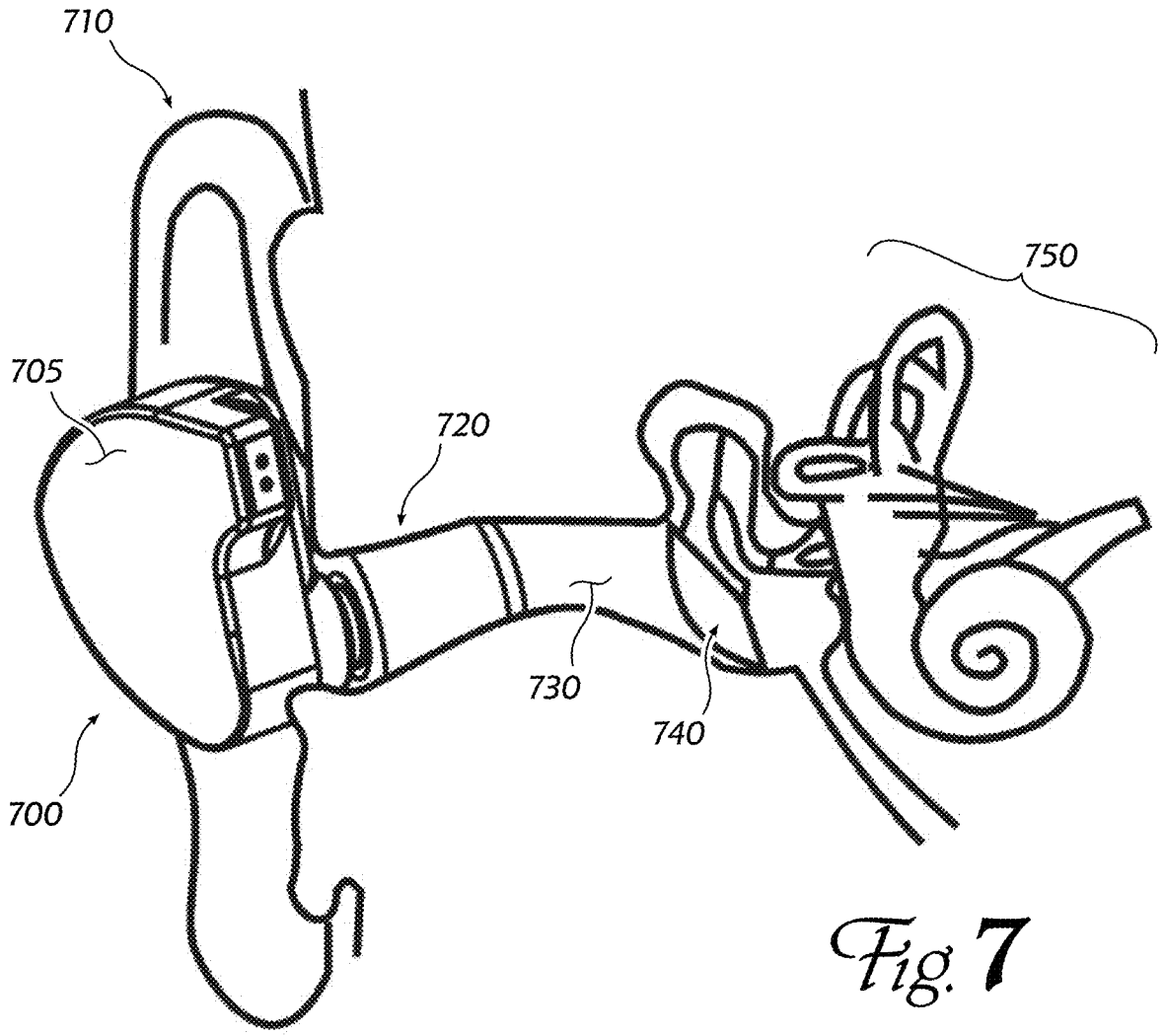
FIG. 7 is a view of another embodiment in place in a user's ear.

FIG. 7 shows a partially cut-away view of another embodiment 700, being worn by a user. The headphone in this figure is provided with a cover 705 that substantially seals the airspace inside. The enlarged portion of the embodiment rests, at least in part, in the user's outer ear 710. The protrusion or stem 720 extends into an outer portion of the user's ear canal and seals thereto, creating a substantially sealed airspace inside the user's ear canal (730). At the far end of the ear canal, the user's tympanic membrane 740 and middle/inner ear anatomical structures 750 are found. Within embodiment 700, both direct-radiating and tube- or slot-radiating balanced armatures (transducers) convert electrical signals into sound waves, which enter the user's ear canal and can be heard. Since the ear canal is substantially sealed, sounds and noise from the external environment are attenuated or blocked.

Figure 8:
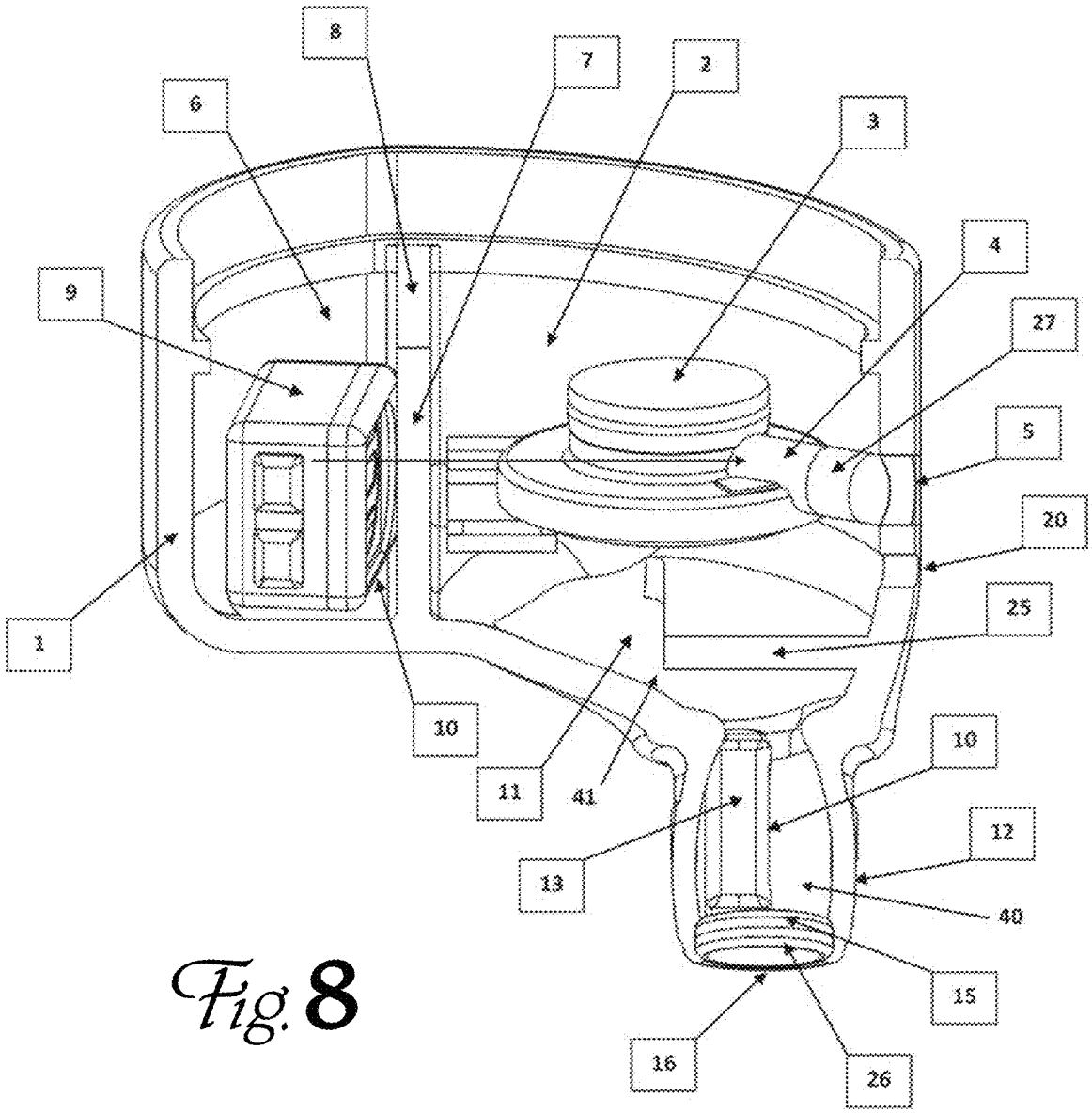
FIG. 8 shows another arrangement according to an embodiment.

It will be appreciated that while FIG. 8 shows one personal listening device 29, a pair of devices 29 may be worn by a user in order to reproduce sound in both ears. The two devices may be physically identical, but more often they will be constructed as complementary, roughly mirror-image pairs to suit the user's left and right ears.

In an embodiment, personal listening device 29 does not include any sound tubes or bores extending from the one or more drivers 3, 9, 13 to the tip 16 of the device 29. By eliminating the sound tubes or bores used in traditional personal listening devices, personal listening device 29 reproduces sound to the user's ear drum without the undesirable effects of tube resonances, such as those shown in prior art FIG. 11 (curved arrows inside tube 44).

In an embodiment, the housing 1 may be divided into two or more chambers 6, 2 via one or more walls 7. In an embodiment, wall 25 may also be included which separates chamber 2 from stem 12, forming another chamber 40. Housing 1 may have as many walls 7, 25 as necessary to produce the desirable frequency response from the personal listening device 29. In another embodiment, the housing 1 may be one single air space, without any walls, such that only one chamber is present.

Figure 10:
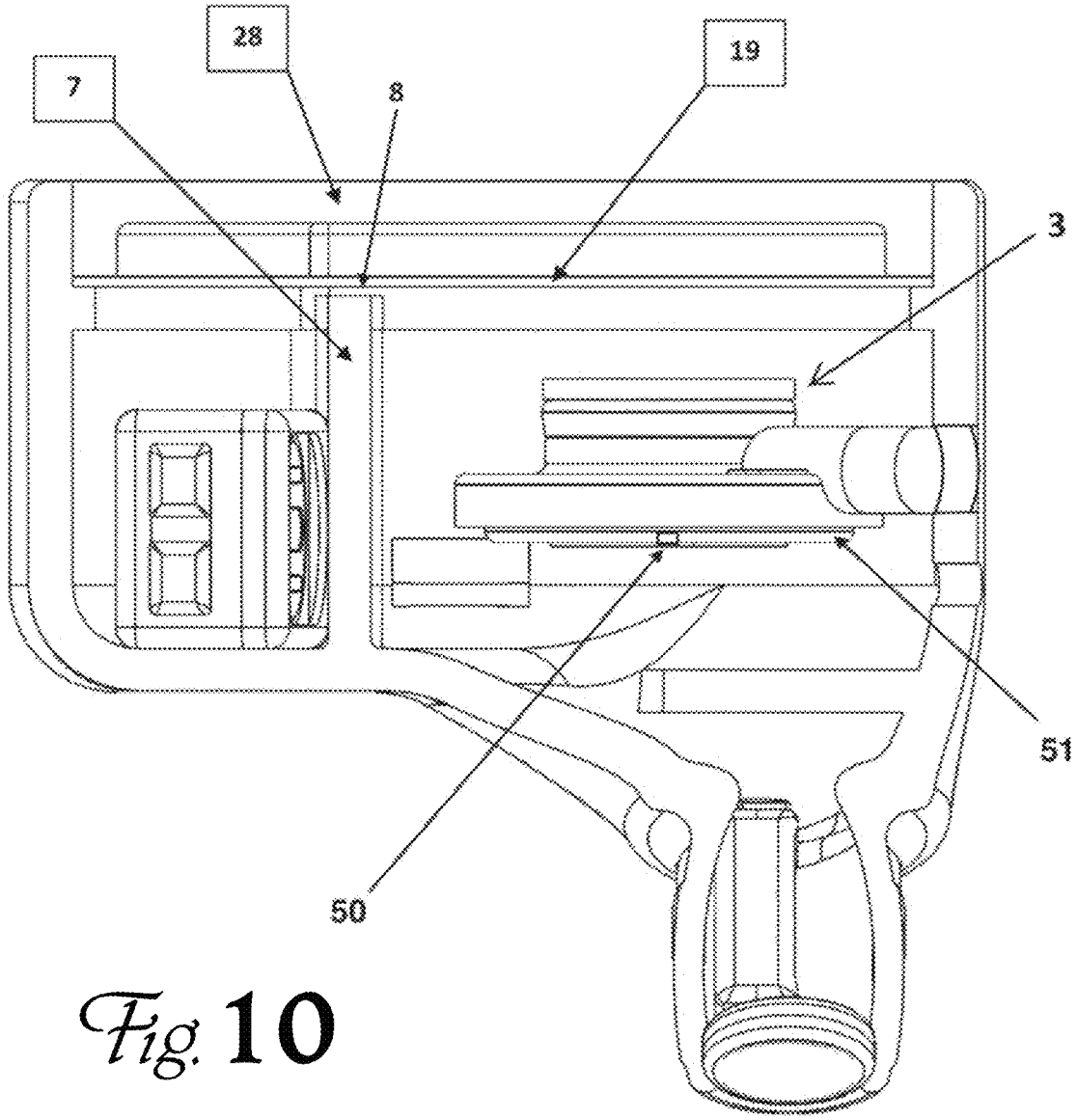
FIG. 10 shows another arrangement according to an embodiment

In an embodiment, the one or more chambers 6, 2, 40 may hold one or more drivers 3, 9, 13. Furthermore, changing physical dimensions of these the one or more chambers 6, 2, 40 and the location of these chambers 6, 2 in respect to chamber 40 give each driver(s) that are contained in that chamber preferred sound characteristics. For example, for a driver 9 that insufficiently reproduces frequencies above 4 kHz, a chamber 6 of proper dimensions may be formed by placing a wall 7 in housing 1 with a thin opening 8 to a passive radiator 19 (as shown in FIG. 10). Wall 7 and any additional walls used in the housing 1 may either be integrated with the housing 1 or may be formed from a separate piece that is attached to housing 1. Opening 8 may be created by a gap between wall 7 and the passive radiator 19, as shown in FIG. 10, or it may be created by a gap between wall 7 and any side of housing 1. In an embodiment which does not include passive radiator 19, opening 8 may be created by a gap between wall 7 and faceplate 28, or it may be created by a gap between wall 7 and any side of housing 1. In an embodiment, opening 8 may be created by perforating less than an entire portion of wall 7 with very small perforations.

Vent 20 may be a predetermined size or be a variably sized port that allows for introduction of ambient sound into the system.

In an embodiment, housing 1 includes driver 3, which may be of any frequency response. In an embodiment, driver 3 is a low frequency driver. Driver 3 may be any type of driver, such as balanced armature, moving coil, dynamic, piezoelectric, planar, electrostatic, or any other type of driver. In an embodiment, driver 3 is a dynamic driver.

In an embodiment, the one or more chambers 2, 6, 40 of housing 1 may be lined with acoustically absorptive or dampening material such as foam, silicone, fiber, or the like. In an embodiment, the acoustically absorptive or dampening material may be open cell foam. By lining the one or more chambers 2, 6, 40 with this material acoustically absorptive or dampening material, the amount of reflections and resonances within the lined chamber 2, 6, 40 may be controlled. In an embodiment with two or more chambers, fewer than all of the chambers may be lined with said acoustically absorptive or dampening material. In another embodiment with two or more chambers, all of the chambers may be lined with said acoustically absorptive or dampening material.

Figure 9:
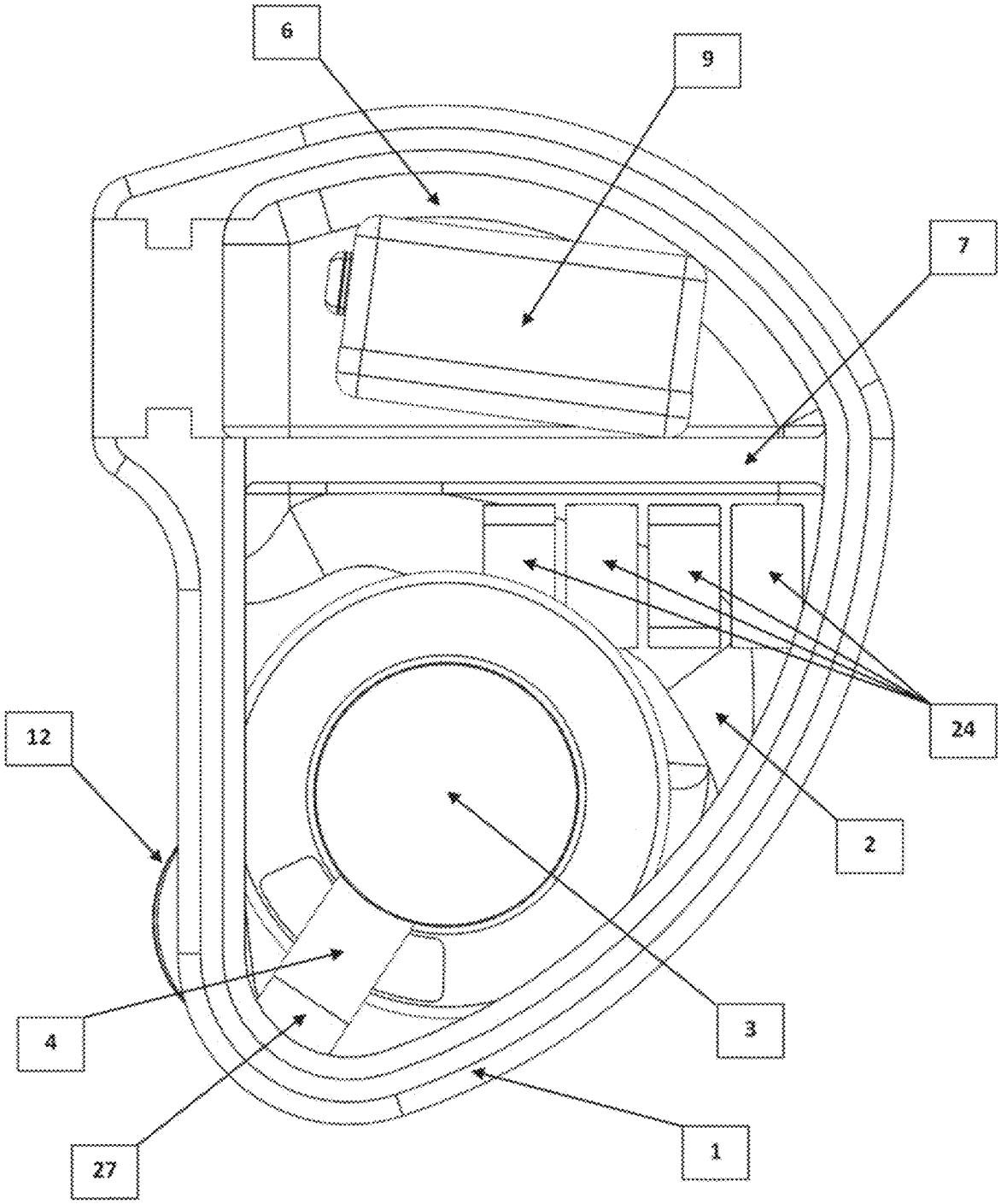
FIG. 9 shows another arrangement according to an embodiment.

In an embodiment, a personal listening device 29 with two or more chambers 2, 6, 40, the output from the one or more drivers located in a particular chamber may bleed or exit into another chamber via an opening or slot 8 between the chambers. For example, in the embodiment personal listening device 29 shown in FIGS. 8-10, the output from driver 9 located within chamber 6 may bleed or exit chamber 6 into chamber 2 via opening 8. That output from driver 9 may then combine in chamber 2 with the output from driver 3, and the combined output from both drivers 9, 3 may then bleed or exit opening 41 through cone 11 and into sound stem 12. From sound stem 12, the combined output may then exit the personal listening device 29 and, when the personal listening device is worn by a user, enter the user's ear canal.

In an embodiment, filter 15 is made of a soft screen with very tight weave. Filter 15 may be waterproof to prevent sweat and other moisture from entering the system. In an embodiment, personal listening device 29 further includes an external screen 26 placed at or near the tip 16 of the device 29. External screen 26 may be included to protect filter 15 from punctures, earwax and other elements. External screen 26 may be rigid and may be made of plastic, stainless steel, or similar material capable of protecting filter 15 from being damaged or punctured.

In an embodiment, one or more drivers in the housing 1 may be back-vented. In an embodiment, driver 3 is a back-vented driver. To back-vent driver 3, tube 4 is attached to the back vent of the driver 3 and "exhausted" through vent 5 to the outside environment of the housing 1. By back-venting driver 3, the diaphragm of the driver 3 is able to move more freely. In an embodiment, back-vented driver 3 is a low frequency driver, such that back-venting driver 3 allows for the diaphragm of the back-vented driver 3 to move more freely at low frequencies and therefore improve the low frequency response of back-vented driver 3.

An embodiment personal listening device 29 may use one or more front-vented drivers, one or more back-vented drivers, or any combination of front-vented and back-vented drivers. A driver may be both front-vented and back-vented.

According to various aspects of the invention described above and illustrated in FIGS. 8-10, an embodiment personal listening device 29 is capable of reproducing sound via one or more drivers to a user without the use of any sound tubes or bores running from the one or more drivers to the tip 16 of the device 29. By omitting any sound tubes or bores, the sound quality of the device 29 is improved, and the linearity to the frequency response of the drivers is restored, reducing resonant peaks and distortion.

Figure 11:
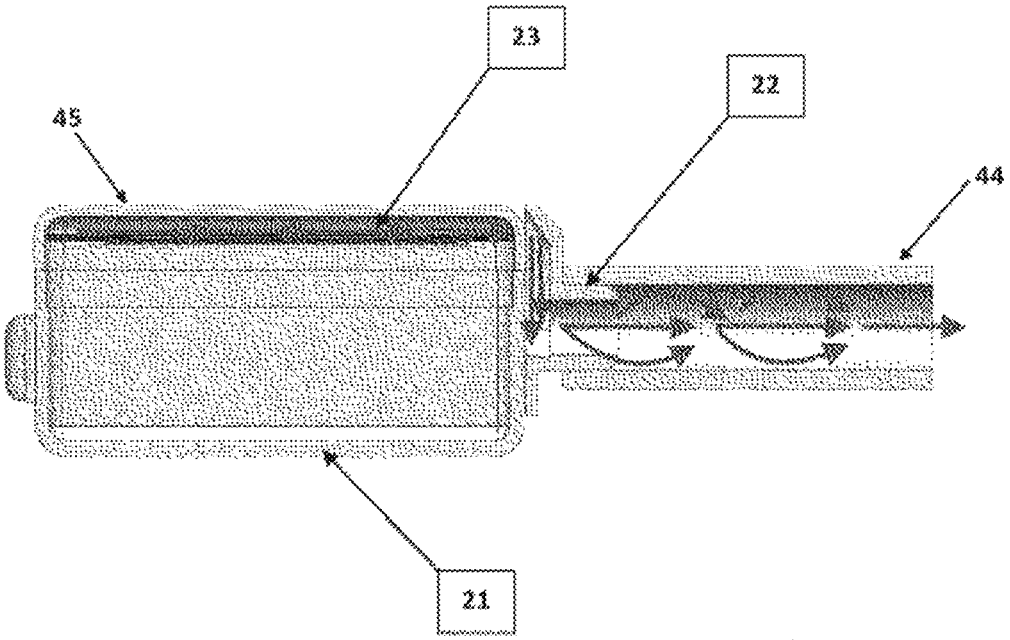
FIG. 11 illustrates tube resonances affecting some driver arrangements.

Turning back to the prior art combination 43 shown in FIG. 11, when a tube 44 is connected to a driver 45, even with small lengths, the tube introduces tube resonance, which is a multitude of peaks and valleys in the frequency response of the driver 45 connected to the tube 44. Furthermore, tubes increase the velocity of the sound pressure traveling through them. The sound is concentrated down a small tube and is only released after it escapes from the tip of the tube. This constriction on the sound waves in the tube has a negative effect on the overall fidelity of the system, and is audible. Tubes may also easily get clogged with ear wax and other debris.

However, according to various aspects of the invention described above and illustrated in FIGS. 8-10, the open-air system of the personal listening device 29 embodiments described herein allows for the sound to immediately scatter or fan out once it leaves its origin, i.e., the surface of the driver diaphragm 18. By omitting all sound tubes or bores, tube resonance is eliminated.

Also disclosed is a method of tuning a personal listening device 29 according to aspects of the invention. The method includes selecting the one or more drivers to be placed in one or more chambers in the housing 1. In another embodiment, the personal listening device 29 may have more than one driver, which are all placed within a single chamber in the housing 1. In another embodiment, the personal listening device 29 may have more than one driver 3, 9, 13 which are each placed within their own chambers 6, 2, 40 in the housing 1. In another embodiment, the personal listening device 29 may also include one or more drivers 13 placed within the stem 12 of the personal listening device 29; the stem 12 may either be integrated with the housing 1 or may be formed from a separate piece that is attached to housing 1. In an embodiment, the device 29 may include wall 25 such that the one or more drivers 13 located in stem 12 are in an additional chamber 40.

In a personal listening device 29 including two or more chambers 2, 6, the method may further include using the size of the one or more chambers 2, 6 to tune the one or more drivers 9, 3 and to tune the overall personal listening device 29. For example, in an embodiment personal listening device 29, chamber 2 may be sized to be larger than chamber 6, thereby lowering the high frequency extension of that chamber (see FIG. 9). In another embodiment, chamber 2 may be sized to be smaller than chamber 6, thereby raising the frequency response cutoff point of that chamber. Just like speaker boxes require proper dimensions for a given transducer, changing the physical dimensions and reflective properties of the chamber will have a direct impact on the frequency response of the one or more drivers contained in that chamber.

In a personal listening device 29 including two or more chambers 2, 6, the method may further include using the location of each chamber within the housing 1 to tune the one or more drivers 9, 3 and to tune the overall personal listening device 29. The location of each chamber is determined by how close the chamber needs to be to the last chamber 40 to produce a desired frequency response.

The method may further include orienting the one or more drivers 3, 9, 13 in a direction within the one or more chambers 6, 2, 40 that yields a sonically pleasing result. For example, in an embodiment personal listening device 29 which includes drivers 3, 9 and chambers 6, 2 (FIG. 9), driver 3 may be positioned in chamber 2 such that the output of driver 3 is aimed toward the stem 12, and driver 9 may be positioned in chamber 6 such that the output of driver 9 is aimed toward wall 7. By positioning drivers 3, 9 in this manner, one is able to correct for frequency response deficiencies inherent in the driver.

In an embodiment wherein one or more drivers 13 are placed in the stem 12 of the personal listening device 29, the method may further include partially sectioning off the stem 12 with wall 25 to create an additional chamber 40 for the one or more drivers 13 placed in the stem 12 (see FIG. 8). In an embodiment, driver 13 may be a high frequency driver and that is placed directly in stem 12, and stem 12 may be partially sectioned off with wall 25 to create a dedicated high frequency chamber to improve the high frequency driver performance.

Acoustical tuning may alternatively include, or may also include, placing damping material such as open cell foam on or over the front vent 10 of one or more drivers, lining one or more chambers with this damping material, or tensioning or loosening the passive radiator 19. The passive radiator 19 acts as a controlled transducer as it transfers sound from one chamber to the next. In an embodiment device 29 which includes a faceplate 28 (see FIG. 10), passive radiator 19 also prevents resonances from building up in the device 29 because of the close proximity of the faceplate 18, which sits over the one or more chambers 2, 6, to the one or more drivers 3, 9.

The method may include changing the overall size of the housing 1. For instance, if the housing 1 is decreased in size, the individual components in the housing 1 are positioned closer together, whereas if the size of the housing 1 is increased it will cause the individual components to be more spaced apart. Changing the spacing of the individual components within the housing will have an effect on the frequency response, phase response, and overall sound presentation of the personal listening device 29.

The method may include using the height of the one or more walls 8, 25 to tune the one or more drivers 3, 9, 13 and the overall system. For instance, in an embodiment personal listening device 29 with chambers 6, 2 and drivers 9, 3 (see FIG. 9), driver 9 may be tuned by including an opening 8 between the chambers 6, 2. In an embodiment personal listening device 29 further including driver 13 positioned in stem 12 (see FIG. 9), drivers 9, 3 may be tuned by including an opening 41 between chamber 2 and cone 11 (see FIG. 9). Openings 8 and/or 41 act as a frequency shaping wave guide, and thus may be used to tune the frequency response of the driver or drivers that output sound through the opening 8, 41. In another embodiment, walls 7 may instead be coextensive with passive radiator 19, i.e., there may be no opening 8 between chamber 6 and chamber 2.

In an embodiment, opening 8 may be a relatively long and narrow slot created by the gap between wall 7 and passive radiator 19 (see FIG. 10). Alternatively, opening 8 may be a slot created by a gap between wall 7 and any side of housing 1. In an embodiment, opening 41 may be a slot created by the gap between wall 25 and the side of cone 11 (see FIG. 8). In an embodiment, opening 8 may be created by perforating less than an entire portion of wall 7 with very small perforations. In an embodiment, opening 41 may be created by perforating less than an entire portion of wall 25 with very small perforations. In an embodiment with more than one wall 7, 25, each of the more than one walls 7, 25 may include an opening 8, 41. In another embodiment with more than one wall 7, 25, less than each of the walls 7, 25 may include an opening 8, 41. In an embodiment, the one or more openings 8, 41 may be covered or stuffed with acoustical foam or other similar material to further control the frequency. In another embodiment, there may be no opening 8 between chambers 6 and 2.

The method may further include shaping the overall frequency response of the system using a filter 15 inserted in stem 12 or attached to stem 12. In an embodiment, once the one or more individual drivers have been tuned, filter 15 can be inserted close to the tip 16 of the stem 12. Filter 15 can be used to further eliminate any resonances that have been created in the system and to control the mid, mid-high and high frequencies. The method may further include adding an external screen 26 with which to protect filter 15 from damage.

The method further includes placing a passive radiator 19 in the housing 1 such that the passive radiator 19 is positioned over top of all chambers 6, 2 and can ultimately deliver sound to the sound stem 12 of the device 29.

The method further includes covering the housing 1 with a faceplate 28, the faceplate included to reject external sounds and noise from the system and also protect the passive radiator 19 from damage.

The method may further include using one or more of the chamber size, the wall height, and/or the location of each chamber within the housing to tune the drivers 9, 3, 13. The method may further include changing the overall size of the housing 1 to affect the frequency response, phase response, and overall sound presentation of the personal listening device 29.

The method may further include tuning driver 9 by including an opening 8 between chambers 6 and 2. The method may further include tuning drivers 9 and 3 by including an opening 41 between chamber 2 and cone 11. The method may further include covering or stuffing one or more openings 8, 41 with acoustical foam or other similar material to further tune the drivers.

An audio reproduction device according to an embodiment of the invention may include several distinguishing features, such as a housing suitable for positioning near a user's outer ear, said housing comprising a protrusion configured to extend at least partially into an outer portion of the user's ear canal and to substantially seal the ear canal; a first balanced armature configured to emit first sound waves, said first sound waves conducted to the substantially sealed ear canal by a tube within the protrusion; a second balanced armature configured to emit second sound waves, said second sound waves radiated directly into an interior of the housing; and an electronic crossover network to receive an electrical signal and deliver a first portion thereof to the first balanced armature, and a second portion thereof to the second balanced armature. Such a device might optionally be characterized by the second balanced armature being positioned to emit said second sound waves toward the user's eardrum. Such a device might optionally be characterized by the second balanced armature being positioned to emit said second sound waves transversely across the user's ear canal. Such a device might optionally be characterized by the tube carrying the first sound waves being adjacent the interior of the housing where the second sound waves travel. Such a device might further comprise at least one additional acoustic driver configured to emit sound waves into the substantially sealed ear canal. Such a device might optionally be characterized by the at least one additional acoustic driver being a dynamic driver. Such a device might further comprise an acoustically opaque vent to allow air to enter or escape the substantially sealed ear canal. Such a device might further comprise a wall to divide the housing into at least one chamber containing the second balanced armature, said at least one chamber lined with an acoustically absorptive material.

Another audio reproduction device according to an embodiment of the invention may include several distinguishing features, such as a housing having a protruding stem suitable for entering and substantially sealing to a user's outer ear canal, an interior volume of said housing and protruding stem thus forming a substantially closed airspace adjacent the user's eardrum; a first balanced-armature audio transducer module to emit first sound waves, said first sound waves exiting the transducer module through an opening in a casing thereof; a second balanced-armature audio transducer to emit second sound waves, said second sound waves emitted directly into the interior volume of the housing from a diaphragm that is exposed and visible; and an electronic crossover network to receive an electrical signal and deliver a first portion thereof to the first balanced-armature audio transducer module, and a second portion thereof to the second balanced-armature audio transducer. Such a device might optionally be characterized by the first sound waves traveling through a tube coupled to the first balanced-armature audio transducer module before entering the substantially closed airspace adjacent the user's eardrum. Such a device might optionally be characterized by the first sound waves traveling through a bore formed in the housing before entering the substantially closed airspace adjacent the user's eardrum. Such a device might optionally be characterized by a diaphragm of the first balanced-armature audio transducer not being visible through the opening in the casing. Or the device might optionally be characterized by a diaphragm of the first balanced-armature audio transducer being visible through the opening in the casing. Such a device might optionally be characterized by the housing being divided into at least two chambers by at least one wall, a configuration of at least one chamber chosen with respect to a sound characteristic of a driver disposed within the at least one chamber.

Yet another audio reproduction device according to an embodiment of the invention might include several distinguishing features, such as a housing having a protruding stem suitable for entering and substantially sealing to a user's outer ear canal, an interior volume of said housing and protruding stem thus forming a substantially closed airspace adjacent the user's eardrum; a first balanced-armature acoustic transducer to emit first sound waves from a radiating diaphragm and into an enclosed shell, said first sound waves exiting the first balanced-armature acoustic transducer through an opening in the enclosed shell; a direct-radiating balanced-armature acoustic transducer to emit second sound waves, said second sound waves emitted into the interior volume of the housing adjacent the first balanced-armature acoustic transducer; and an electronic crossover network to receive an electrical audio signal and deliver a first portion thereof to the first balanced armature acoustic transducer and a second portion thereof to the direct-radiating balanced armature acoustic transducer. Such a device might further include a moving-coil audio transducer within the housing, said moving-coil audio transducer receiving a third portion of the electrical audio signal from the electronic crossover network and emitting corresponding third sound waves into the substantially closed airspace adjacent the user's eardrum. Such a device might optionally be characterized by the moving-coil audio transducer comprising a back vent communicating with an atmosphere outside the substantially closed airspace adjacent the user's eardrum. Such a device might optionally be characterized by the back vent including a tuned filter to control a low-frequency response of the moving-coil audio transducer. Such a device might further include an acoustically-opaque vent to permit air to enter or escape slowly from the substantially closed airspace. Such a device might further include an acoustically transparent screen at an end of the protruding stem.

The applications of the present invention have been described largely by reference to specific examples and in terms of particular arrangements of components and structures. However, those of skill in the art will recognize that earphones comprising direct-radiating transducers can also be constructed in various alternate forms and arrangements. Such variations and alternate arrangements are understood to be captured according to the following claims.

We claim:

1. An audio reproduction device comprising:

a housing suitable for positioning near a user's outer ear, said housing comprising a protrusion configured to extend at least partially into an outer portion of the user's ear canal and to substantially seal the ear canal;

a first balanced armature configured to emit first sound waves, said first sound waves conducted to the substantially sealed ear canal by a tube within the protrusion;

a second balanced armature configured to emit second sound waves, said second sound waves radiated directly into the substantially sealed ear canal without passing through a tube; and an electronic crossover network to receive an electrical signal and deliver a first portion thereof to the first balanced armature, and a second portion thereof to the second balanced armature.

2. The audio reproduction device of claim 1 wherein the second balanced armature is positioned to emit said second sound waves toward the user's eardrum.

3. The audio reproduction device of claim 1 wherein the second balanced armature is positioned to emit said second sound waves transversely across the user's ear canal.

4. The audio reproduction device of claim 1 wherein the second balanced armature is secured in the protrusion and positioned within the user's ear canal when the user wears the device.

5. The audio reproduction device of claim 1, further comprising:

at least one additional acoustic driver configured to emit sound waves into the substantially sealed ear canal.

6. The audio reproduction device of claim 5 wherein the at least one additional acoustic driver is a dynamic driver.

7. The audio reproduction device of claim 1, further comprising:

an acoustically opaque vent to allow air to enter or escape the substantially sealed ear canal.

8. An audio reproduction device comprising:

a housing suitable for positioning near a user's outer ear, said housing comprising a protrusion configured to extend at least partially into an outer portion of the user's ear canal and to substantially seal the ear canal;

a first balanced armature configured to emit first sound waves, said first sound waves conducted to the substantially sealed ear canal by a tube within the protrusion;

a second balanced armature configured to emit second sound waves, said second sound waves radiated directly into an interior of the housing;

an electronic crossover network to receive an electrical signal and deliver a first portion thereof to the first balanced armature, and a second portion thereof to the second balanced armature; and a wall to divide the housing into at least one chamber containing the second balanced armature, said at least one chamber lined with an acoustically absorptive material.

9. An audio reproduction device comprising:

a housing having a protruding stem suitable for entering and substantially sealing to a user's outer ear canal, an interior volume of said housing and protruding stem thus forming a substantially closed airspace adjacent the user's eardrum;

a first balanced-armature acoustic transducer to emit first sound waves from a radiating diaphragm and into an enclosed shell, said first sound waves exiting the first balanced-armature acoustic transducer through an opening in the enclosed shell;

a direct-radiating balanced-armature acoustic transducer to emit second sound waves, said second sound waves emitted into the interior volume of the housing adjacent the first balanced-armature acoustic transducer;

an electronic crossover network to receive an electrical audio signal and deliver a first portion thereof to the first balanced armature acoustic transducer and a second portion thereof to the direct-radiating balanced armature acoustic transducer;

a moving-coil audio transducer within the housing, said moving-coil audio transducer receiving a third portion of the electrical audio signal from the electronic crossover network and emitting corresponding third sound waves into the substantially closed airspace adjacent the user's eardrum, wherein the moving-coil audio transducer comprises a back vent communicating with an atmosphere outside the substantially closed airspace adjacent the user's eardrum, and wherein the back vent comprises a tuned filter to control a low-frequency response of the moving-coil audio transducer.

* * * * *